US010215192B2

(12) United States Patent
Griffin

(10) Patent No.: US 10,215,192 B2
(45) Date of Patent: Feb. 26, 2019

(54) STATOR VANE SYSTEM USABLE WITHIN A GAS TURBINE ENGINE

(71) Applicant: Siemens Aktiengesellschaft, München (DE)

(72) Inventor: Elliot Griffin, Winter Springs, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/323,895

(22) PCT Filed: Jul. 24, 2014

(86) PCT No.: PCT/US2014/047948
§ 371 (c)(1),
(2) Date: Jan. 4, 2017

(87) PCT Pub. No.: WO2016/014057
PCT Pub. Date: Jan. 28, 2016

(65) Prior Publication Data
US 2017/0152866 A1 Jun. 1, 2017

(51) Int. Cl.
*F04D 29/64* (2006.01)
*F01D 9/04* (2006.01)
(Continued)

(52) U.S. Cl.
CPC ..... *F04D 29/644* (2013.01); *F01D 9/042* (2013.01); *F01D 11/001* (2013.01);
(Continued)

(58) Field of Classification Search
CPC . F01D 9/04; F01D 9/041; F01D 9/042; F01D 11/00; F01D 11/001; F04D 29/644; F04D 29/083; F04D 29/542
See application file for complete search history.

(56) References Cited

U.S. PATENT DOCUMENTS 2,658,719 A * 11/1953 Johanson ..... F01D 9/042 415/209.4
3,547,455 A 12/1970 Daunt
(Continued)

FOREIGN PATENT DOCUMENTS

CA 2560561 A1 5/2007
EP 0384166 A2 8/1990
(Continued)

OTHER PUBLICATIONS

PCT International Search Report and Written Opinion dated May 21, 2015 corresponding to PCT Application No. PCT/US2014/047948 filed Jul. 24, 2014.

*Primary Examiner* — Richard A Edgar
*Assistant Examiner* — Danielle M. Christensen

(57) ABSTRACT

A stator assembly (10) usable in a gas turbine engine (12) and configured to restrain inner and outer endwalls (14, 16) to limit deflection and prevent clearance loss relative to adjacent blade rotor disks (18) is disclosed. The stator assembly (10) may be formed from a plurality of stator vanes (20) with inner and outer endwalls (14, 16) that are coupled together with a first radially outer tie bar (22). In at least one embodiment, first and second radially outer tie bars (22, 24) may form first and second stator vane segments (26, 28) that together form the circumferentially extending stator assembly (10). The inner and outer endwalls (14, 16) may be coupled together with one or more circumferentially extending alignment pins (30) that limit deflection. The stator assembly (10) may include one more deformable seals (52) extending radially inward from the inner endwall (14).

13 Claims, 4 Drawing Sheets

(51) Int. Cl.

| | |
|---|---|
| ***F01D 11/12*** | (2006.01) |
| ***F01D 11/00*** | (2006.01) |
| ***F01D 25/24*** | (2006.01) |
| ***F04D 29/08*** | (2006.01) |
| ***F04D 29/54*** | (2006.01) |

(52) U.S. Cl.

CPC ..... *F01D 11/127* (2013.01); *F01D 25/246* (2013.01); *F04D 29/083* (2013.01); *F04D 29/542* (2013.01); *F05D 2230/64* (2013.01); *F05D 2260/30* (2013.01); *F05D 2300/505* (2013.01)

(56) References Cited

U.S. PATENT DOCUMENTS

| | | | | |
|---|---|---|---|---|
| 3,842,595 | A | 10/1974 | Smith et al. | |
| 3,849,023 | A | 11/1974 | Klompas | |
| 4,063,847 | A | 12/1977 | Simmons | |
| 4,645,424 | A | 2/1987 | Peters | |
| 5,022,818 | A * | 6/1991 | Scalzo | F04D 29/542 415/189 |
| 5,180,281 | A | 1/1993 | Burge et al. | |
| 5,653,581 | A | 8/1997 | Dixon et al. | |
| 6,179,560 | B1 * | 1/2001 | Kouris | F01D 9/042 415/190 |
| 6,296,443 | B1 | 10/2001 | Newman et al. | |
| 6,652,226 | B2 | 11/2003 | Albrecht, Jr. et al. | |
| 6,984,108 | B2 | 1/2006 | Anderson et al. | |
| 7,284,955 | B2 | 10/2007 | Vieillefond et al. | |
| 8,128,354 | B2 | 3/2012 | Hansen et al. | |
| 8,206,094 | B2 | 6/2012 | Seki et al. | |
| 8,347,500 | B2 | 1/2013 | Durocher et al. | |
| 8,528,181 | B2 | 9/2013 | Maurell et al. | |
| 2005/0191177 | A1 | 9/2005 | Anderson et al. | |
| 2007/0134090 | A1 * | 6/2007 | Heyward | F01D 9/023 415/209.2 |
| 2007/0177973 | A1 * | 8/2007 | Seki | F01D 5/225 415/191 |
| 2007/0274825 | A1 * | 11/2007 | De Martino | F01D 11/001 415/173.1 |
| 2008/0101927 | A1 * | 5/2008 | Strain | F01D 9/042 415/209.3 |
| 2010/0129211 | A1 | 5/2010 | Hart et al. | |
| 2013/0052024 | A1 * | 2/2013 | Brunt | F01D 9/041 416/220 R |
| 2013/0232788 | A1 | 9/2013 | Spanos et al. | |
| 2013/0259673 | A1 | 10/2013 | Waki et al. | |
| 2014/0271146 | A1 * | 9/2014 | Dietrich | F04D 29/644 415/173.1 |

FOREIGN PATENT DOCUMENTS

| | | | | |
|---|---|---|---|---|
| EP | 1306591 | A2 | 5/2003 | |
| EP | 1039096 | B1 | 10/2009 | |
| FR | 2715968 | A1 * | 8/1995 | F01D 5/143 |
| GB | 760518 | | 10/1956 | |
| GB | 777835 | | 6/1957 | |
| GB | 785466 | | 10/1957 | |
| GB | 1083373 | | 9/1967 | |
| GB | 1089572 | | 11/1967 | |
| GB | 1095376 | | 12/1967 | |
| JP | S60-088002 | U | 6/1985 | |
| JP | 2008144687 | A | 6/2008 | |

* cited by examiner

STATOR VANE SYSTEM USABLE WITHIN A GAS TURBINE ENGINE

FIELD OF THE INVENTION

This invention is directed generally to stator vane airfoils within gas turbine engines, and more particularly to support systems for stator vane airfoils.

BACKGROUND

Turbine engines typically include a plurality of rows of stationary compressor stator vanes extending radially inward from a shell and include plurality of rows of rotatable compressor blades attached to a rotor assembly for turning the rotor. Conventional turbine engines often include a segment with multiple stationary airfoils collectively referred to as a stator. Stator segments deflect in the upstream direction under steady gas pressure loading, and the deflection varies around the circumference dependent upon how the segment is constrained to the casing. The unconstrained ends of the segment deflect more and have less axial clearance to the upstream rotor disk. Such problem has been addressed in U.S. Pat. No. 8,128,354 B2, but requires at least thirteen custom made components and at least twenty two steps to assemble the stator. Thus, a need exists to control deflection and alignment of the stator vane airfoils forming the stator in a more efficient manner.

SUMMARY OF THE INVENTION

A stator assembly usable in a gas turbine engine and configured to restrain inner and outer endwalls to limit deflection and prevent clearance loss relative to adjacent blade rotor disks is disclosed. The stator assembly may be formed from a plurality of stator vanes with inner and outer endwalls that are coupled together with a first radially outer tie bar. In at least one embodiment, first and second radially outer tie bars may form first and second stator vane segments that together form the circumferentially extending stator assembly. The inner and outer endwalls may be coupled together with one or more circumferentially extending alignment pins that limit deflection. The stator assembly may include one more deformable seals extending radially inward from the inner endwall, whereby the deformable seal may include an upstream facing contact surface and radially inward facing contact surface.

In at least one embodiment, the stator assembly for a gas turbine engine may include a plurality of stator vanes, each formed from a generally elongated airfoil having a leading edge, a trailing edge, a pressure side, a suction side, an inner endwall coupled to a first end and an outer endwall coupled to a second end opposite the first end. The stator assembly may also include a first radially outer tie bar coupled to each outer endwall of a portion of the stator vanes and one or more inner alignment pins extending between adjacent inner endwalls to couple adjacent inner endwalls together. The stator assembly may include one or more forward inner seal rings attached to the inner endwall and one or more deformable seals coupled to at least one radially inner surface of the forward inner seal ring.

In at least one embodiment, the one or more of the stator vanes may be integrally formed with the inner endwall and outer endwall. In another embodiment, each of the stator vanes may be integrally formed with the inner endwall and outer endwall. The first radially outer tie bar may be positioned within a recess in a radially outer surface the outer endwall. A second radially outer tie bar may be coupled to each outer endwall of remaining stator vanes not attached to the first radially outer tie bar, thereby forming a first stator vane segment and a second stator vane segment that together form the circumferentially extending stator assembly. The stator assembly may also include one or more anti-rotation slots positioned in at least one of two interfaces between the first and second stator vane segments.

The inner alignment pin of the stator assembly may be formed from one or more circumferentially extending forward inner alignment pins and one or more circumferentially extending aft inner alignment pins. The circumferentially extending forward inner alignment pin may be positioned forward of the generally elongated airfoil, and the circumferentially extending aft inner alignment pin may be positioned aft of the generally elongated airfoil.

The stator assembly may also include one or more outer alignment pins extending between adjacent outer endwalls to couple adjacent outer endwalls together. The outer alignment pin may be formed from one or more circumferentially extending forward outer alignment pins and one or more circumferentially extending aft outer alignment pins. The circumferentially extending forward outer alignment pin may be positioned forward of the generally elongated airfoil, and the circumferentially extending aft outer alignment pin may be positioned aft of the generally elongated airfoil.

The stator assembly may also include one or more aft inner seal rings attached to the inner endwall aft of the aft inner alignment pin. The stator assembly may also include one or more deformable seals coupled to a radially inner surface of the at least one aft inner seal ring.

An advantage of the stator assembly is that the stator assembly may be formed from six off-the-shelf components and six custom made components requiring only about 17 steps to manufacture and complete assembly, thereby saving time and money and reducing complexity in contrast to conventional systems.

Another advantage of the stator assembly is that the stator assembly does not require welding, hard coating or stress relieving.

Yet another advantage of the stator assembly is that the stator assembly does not require machining of the entire assembly, which reduces lifting time and the need for large machining tools.

Another advantage of the stator assembly is that the stator assembly does not require coating of the entire assembly, which reduces lifting time, the need for equipment and shipping costs.

Still another advantage of the stator assembly is that the stator assembly enables seal rings to be replaced without cutting or welding.

Another advantage of the stator assembly is that the stator assembly enables individual airfoils to be replaced without cutting or welding.

Yet another advantage of the stator assembly is that the stator assembly allows for mixing cover and base halves between engines, reduces service inventory and handling costs.

Another advantage of the stator assembly is that the stator assembly provides a flexible configuration that could be formed from 90 degree segments to further reduce service inventory and handling costs and increase the ease of assembly and disassembly.

Still another advantage of the stator assembly is that the stator assembly may provide mechanical dampening.

Another advantage of the stator assembly is that the outer and inner seal rings may be bolted, thereby providing for easy assembly and replacement.

Yet another advantage of the stator assembly is that the stator assembly may eliminate leakage due to segmentation in conventional stator assemblies.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
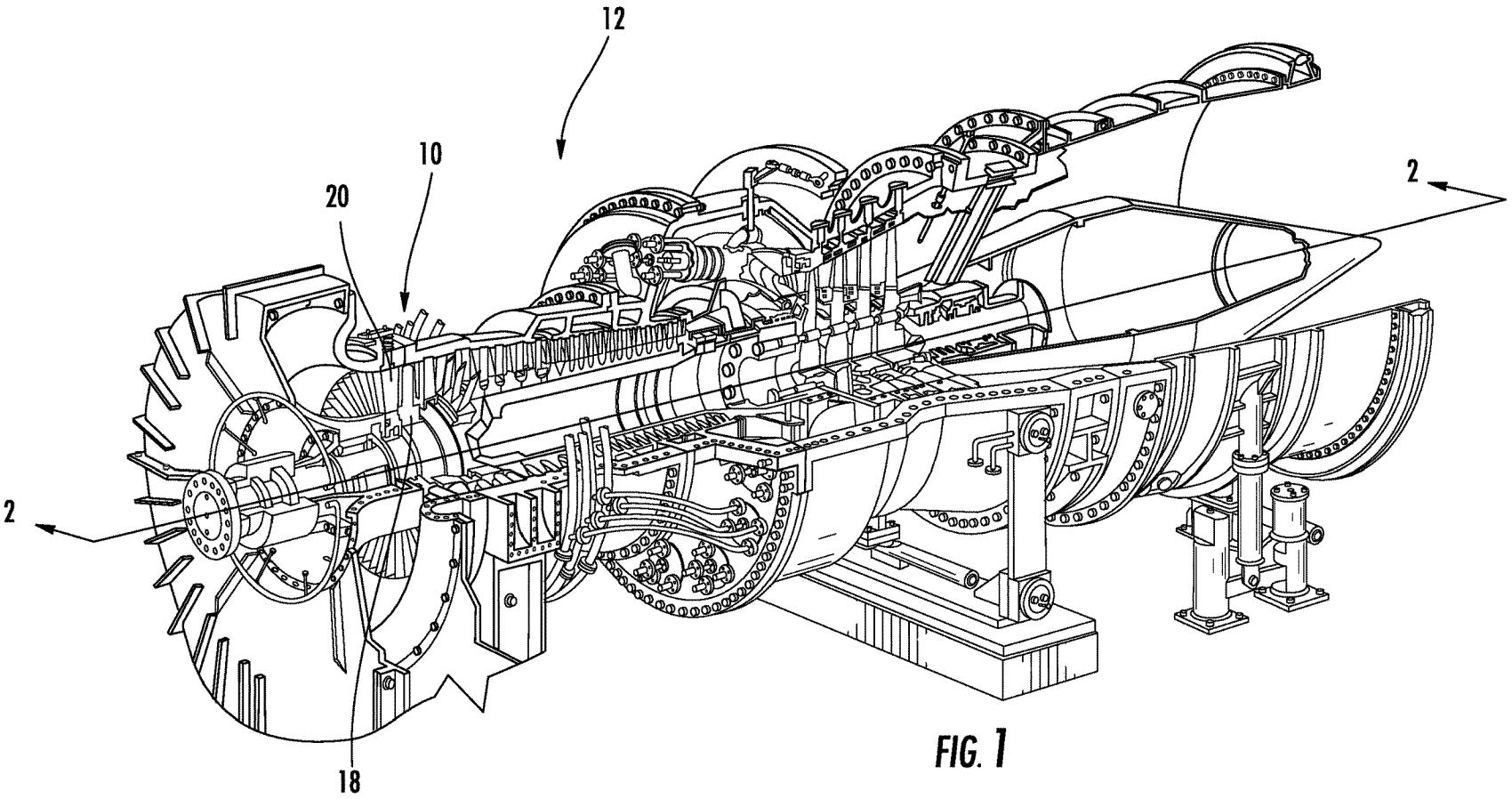
FIG. 1 is a perspective view of compressor stator vane segment within a gas turbine engine.
Figure 2:
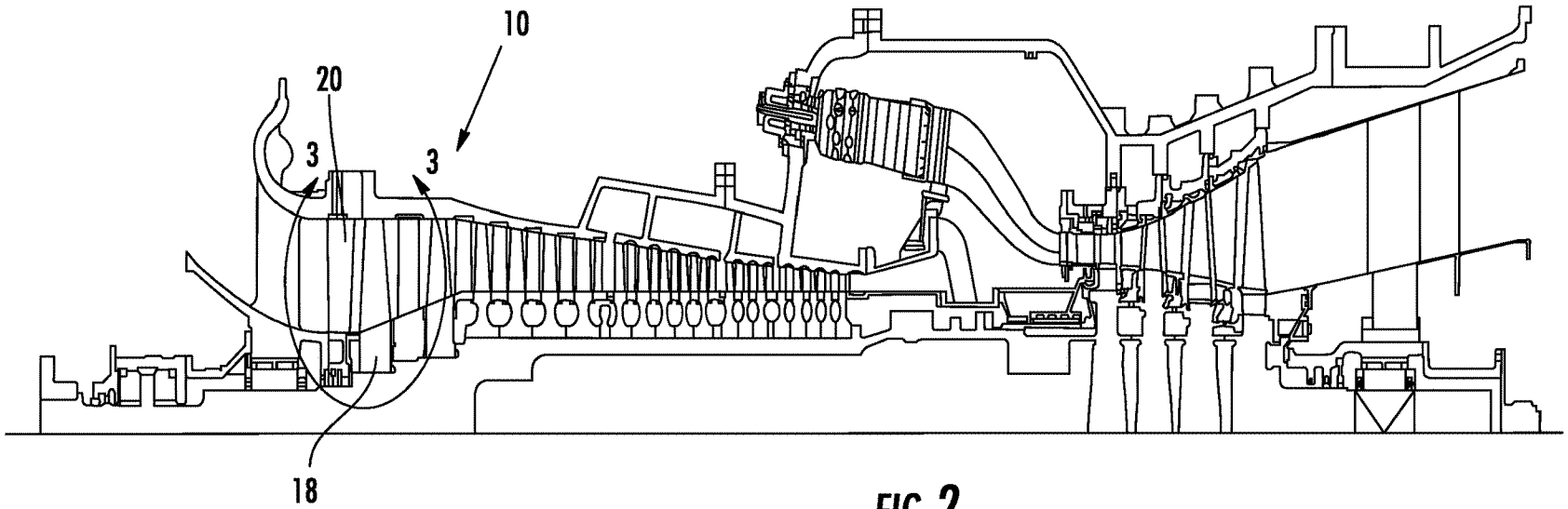
FIG. 2 is a cross-sectional view of a compressor stator vane segment within a gas turbine engine taken at section line 2-2 in FIG. 1.
Figure 3:
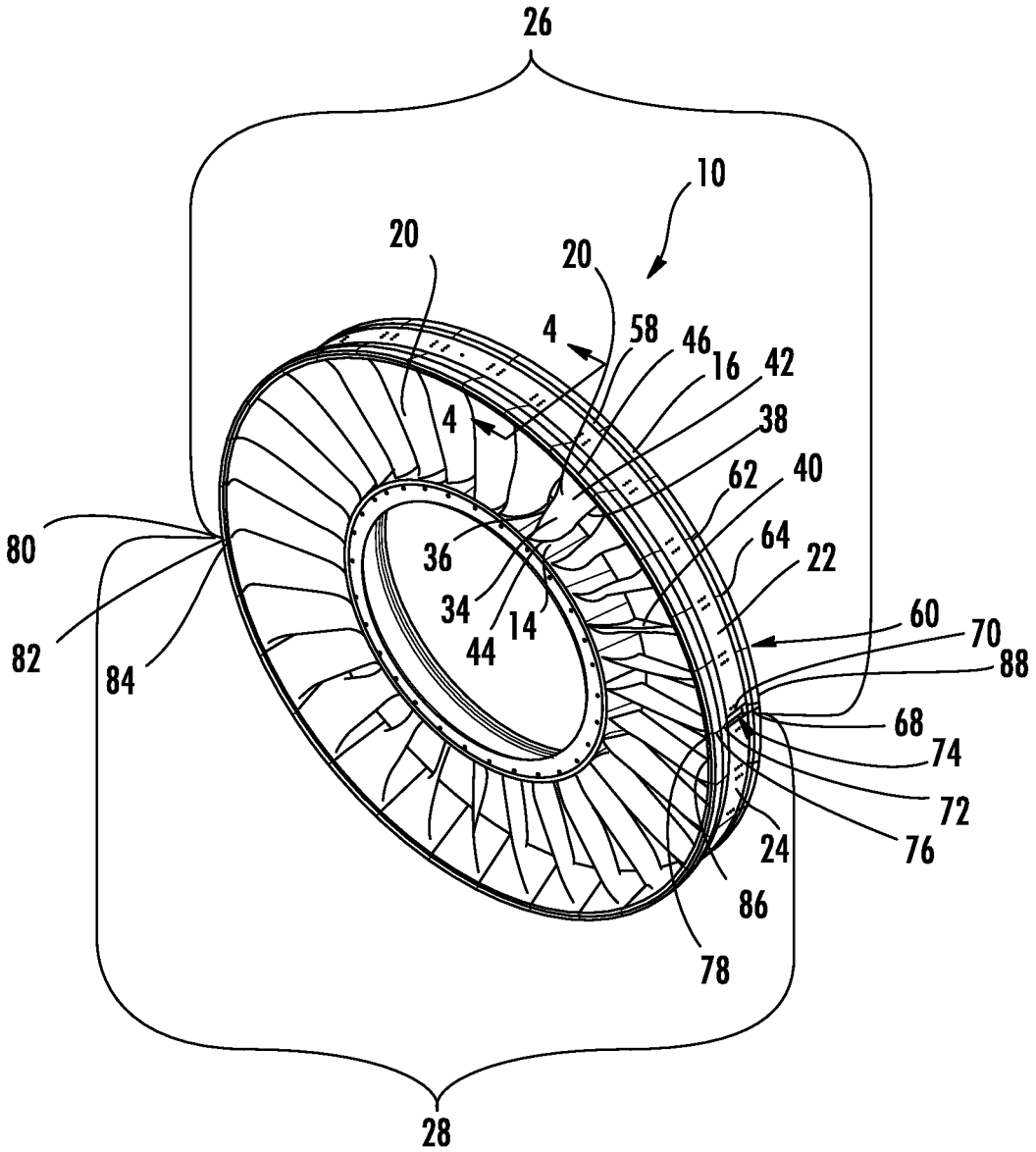
FIG. 3 is a perspective detail view of a stator assembly within a gas turbine engine taken at detail line 3-3 in FIG. 2.

As shown in FIGS. 1-6, a stator assembly 10 usable in a gas turbine engine 12 and configured to restrain inner and outer endwalls 14, 16 to limit deflection and prevent clearance loss relative to adjacent blade rotor disks 18 is disclosed. The stator assembly 10 may be formed from a plurality of stator vanes 20 with inner and outer endwalls 14, 16 that are coupled together with a first radially outer tie bar 22. In at least one embodiment, first and second radially outer tie bars 22, 24, as shown in FIG. 3, may form first and second stator vane segments 26, 28 that together form the circumferentially extending stator assembly 10. The inner and outer endwalls 14, 16 may be coupled together with one or more circumferentially extending alignment pins 30 that limit deflection. The stator assembly 10 may include one more deformable seals 32 extending radially inward from the inner endwall 14.

Figure 4:
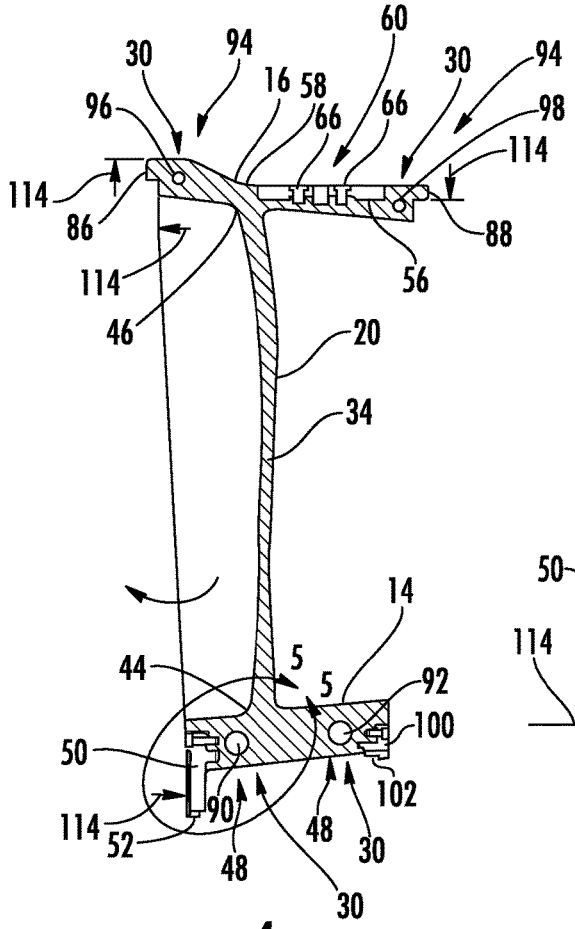
FIG. 4 is a cross-sectional view of an airfoil of the stator assembly taken along section line 4-4 in FIG. 3.

In at least one embodiment, the stator assembly 10 for a gas turbine engine 12 may be formed from a plurality of stator vanes 20, as shown in FIG. 3, each formed from a generally elongated airfoil 34 having a leading edge 36, a trailing edge 38, a pressure side 40, a suction side 42 on an opposite side of the airfoil 34 from the pressure side 40, an inner endwall 14 coupled to a first end 44 and an outer endwall 16 coupled to a second end 46 opposite the first end 44. In at least one embodiment, one or more of the stator vanes 20 may be integrally formed with the inner endwall 14 and outer endwall 16, as shown in FIG. 4. In yet another embodiment, each of the stator vanes 20 may be integrally formed with the inner endwall 14 and outer endwall 16. The generally elongated airfoil 34 may be removed and replaced without welding.

The stator assembly 10 may include a first radially outer tie bar 22 may be coupled to each outer endwall 16 of at least a portion of the stator vanes 20. The first radially outer tie bar 22 may be positioned within a recess 56 in a radially outer surface 58 the outer endwall 16. The first radially outer tie bar 22 may be attached to the outer endwall 16 via one or more connectors 60. In at least one embodiment, as shown in FIG. 3, one or more connectors 60 may be positioned adjacent to a first circumferential end 62 on the outer endwall 16 and one or more connector 60 positioned adjacent to a second circumferential end 64 on the outer endwall 16 which is on an opposite end of the outer endwall 16 from the first circumferential end 62. In at least one embodiment, the at least one connector 60 may be formed from, but is not limited to, one or more bolts, screws, rivets, and other connectors already existing or yet to be conceived. In at least one embodiment, the connector 60 may be formed from a plurality of connectors 60, such as, but not limited to three connectors 60 adjacent to the first circumferential end 62 on the outer endwall 16 and three connectors 60 adjacent to the second circumferential end 64 on the outer endwall 16. In at least one embodiment, the first radially outer tie bar 22 may be attached to the outer endwall 16 via one or more bolts 66 adjacent to the first circumferential end 62 on the outer endwall 16.

The stator assembly 10 may also include a second radially outer tie bar 24 coupled to each outer endwall of remaining stator vanes 20 not attached to the first radially outer tie bar 22 to form a second stator vane segment 28. Similarly, the first radially outer tie bar 22 may couple together a plurality of stator vanes 20 to form the first stator vane segment 26. The first and second radially outer tie bars 22, 24 form the first stator vane segment 26 and the second stator vane segment 28, which together form the circumferentially extending stator assembly 10. In at least one embodiment, the first and second stator vane segments 26, 28 may each form one half of the stator assembly 10 and may be coupled together at a horizontal midpoint 68. The first and second stator vane segments 26, 28 may have other configurations in other embodiments.

The stator assembly 10 may also include one or more anti-rotation slots 70, as shown in FIG. 3, positioned in at least one of two interfaces 72 between the first and second stator vane segments 26, 28. The stator assembly 10 may include a first anti-rotation slot 74 positioned at a first interface 76 between the first and second stator vane segments 26, 28 on a first side 78 of the stator assembly 10 and a second anti-rotation slot 80 positioned on at a second interface 82 between the first and second stator vane segments 26, 28 on a second side 84 of the stator assembly 10, which is on a generally opposite side of the stator assembly 10 from the first side 78. The anti-rotation slot 70 may extend at least partially into both of the first and second stator vane segments 26, 28. The anti-rotation slot 70 may not extend to an upstream edge 86 of the outer endwall 16 or to a downstream edge 88 of the outer endwall 16.

Figure 5:
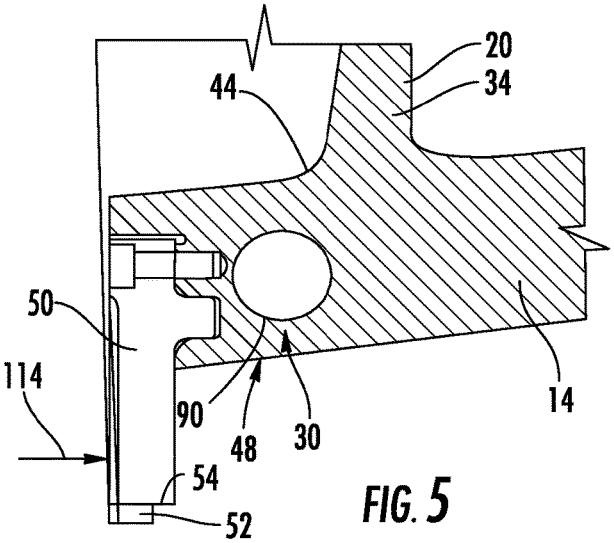
FIG. 5 is a detail view of the inner endwall of the stator assembly taken at detail line 5-5 in FIG. 4.
Figure 6:
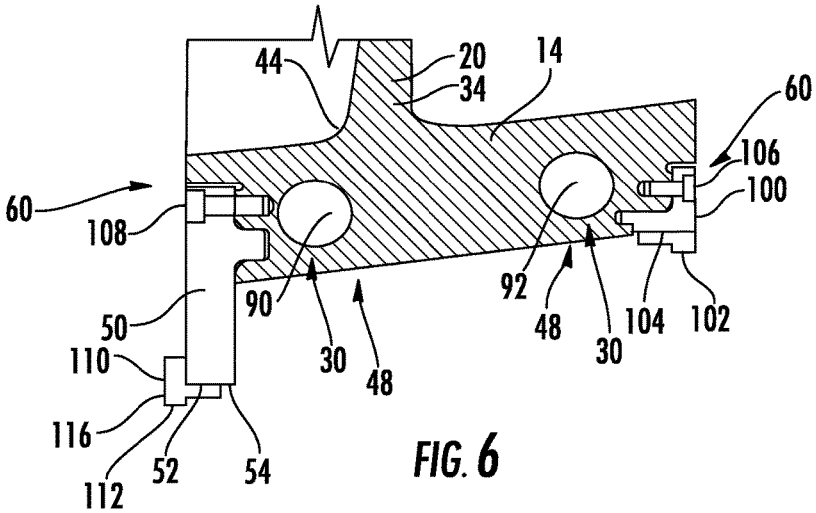
FIG. 6 is a detail view of the inner endwall of the stator assembly shown in FIG. 4.

The stator assembly 10 may also include one or more inner alignment pins 48 extending between adjacent inner endwalls 14 to couple adjacent inner endwalls 14 together, as shown in FIGS. 4-6. In at least one embodiment, the inner alignment pin 48 may be formed from one or more circumferentially extending forward inner alignment pins 90 and one or more circumferentially extending aft inner alignment pins 92. The circumferentially extending forward inner alignment pin 90 may be positioned forward of the generally elongated airfoil 34 and the circumferentially extending aft inner alignment pin 92 may be positioned aft of the generally elongated airfoil 34.

The stator assembly 10 may also include one or more outer alignment pins 94 extending between adjacent outer endwalls 16 to couple adjacent outer endwalls 16 together. In at least one embodiment, the outer alignment pin 94 may be formed from one or more circumferentially extending forward outer alignment pins 96 and one or more circumferentially extending aft outer alignment pins 98. The circumferentially extending forward outer alignment pin 96 may be positioned forward of the generally elongated airfoil 34 and the circumferentially extending aft outer alignment pin 98 may be positioned aft of the generally elongated airfoil 34.

The stator assembly 10 may include one or more forward inner seal rings 50 attached to the inner endwall 14 and one or more deformable seals 52 coupled to one or more radially inner surfaces 54 of the forward inner seal ring 50, as shown in FIGS. 5 and 6. In at least one embodiment, the forward inner seal ring 50 may be removable. The forward inner seal ring 50 may be attached with one or more connectors 60, such as, but not limited to, a forward axial bolt 108. As such, in at least one embodiment, the forward inner seal ring 50 is not attached via a weld, thereby making replacement much faster and less costly. The deformable seal 52 may include an upstream facing contact surface 110 and radially inward facing contact surface 112, as shown in FIG. 6. The upstream facing contact surface 110 may accommodate contact with an upstream rotor disk 18 without risk of mechanical distress or thermal damage to either component. Contact can occur when forces are applied via arrows 114 resulting from gas loading of vanes and pressure on the forward and aft inner seal rings 50, 100. The deformable seal 52 may be, but is not limited to being, a honeycomb shaped seal. In at least one embodiment, the forward inner seal ring 50 may be attached to the inner endwall 14 forward of the forward inner alignment pin 90. One or more coatings 116 may be applied to the deformable seal 52, such as, but not limited to, the upstream facing contact surface 110 or the radially inward facing contact surface 112, or both, to restore the sealing once the deformable seal 52 has been subjected to wear.

In another embodiment, the forward inner seal ring 50 may be formed from a material, such as, but not limited to, a shape memory alloy. Such material may enable the forward inner seal ring 50 to deflect way from contact with an upstream rotor disk 18 when heated by frictional contact. The forward inner seal ring 50 formed from a shape memory material such as via a precision casting that may be more cost effective than conventional systems.

The stator assembly 10 may include one or more aft inner seal rings 100 attached to the inner endwall 14 aft of the aft inner alignment pin 92. One or more deformable seals 102 may be coupled to a radially inner surface 104 of the aft inner seal ring 100. The deformable seal 102 coupled to the aft inner seal ring 100 may be a honeycomb shaped seal or other seal. The aft inner seal ring 100 may be coupled to the inner endwall 14 via one or more connectors 60, such as, but not limited to, an aft axial bolt 106.

In at least one embodiment, the stator assembly 10 may be formed from six custom made components and six off-the-shelf components, such as bolts and pins, all of which are previously described. The stator assembly 10 may include the generally elongated airfoil 34, the first radial outer tie bar 22, the forward inner ring seal 50, the aft inner ring seal 100, the forward deformable seal 52, the aft deformable seal 102, outer radial bolts 60, outer radial pins, the outer alignment pin 94, inner alignment pins 48, the aft axial bolt 106, and the forward axial bolt 108.

A method of manufacturing the stator assembly 10 may include fewer steps than in conventional systems. In at least one embodiment, the stator assembly 10 may be formed from about seventeen steps, including: milling the airfoils 34 from forgings or castings; coating the airfoil flow path surfaces; turning the outer rings from a rolled ring; turning the forward inner seal ring 50 from a rolled ring; turning the aft inner seal ring 100 from a rolled ring; drilling holed in the outer ring; drilling holes in the forward inner seal ring 50; drilling holes in the aft inner seal ring 100; brazing the forward deformable seal 52 to the forward inner seal ring 50; brazing the aft deformable seal 102 to the aft inner seal ring 100; turning or grinding the forward deformable seal 52 inner diameter; turning or grinding the aft deformable seal 102 diameter; cutting the outer ring in half; cutting the forward inner seal ring 50 in half; cutting the aft inner seal ring 100 in half; assembling the airfoils 34 and rings 50, 102 together with bolts 60 and pins 48, 90, 92, 96, 98, line drill, ream radial pin holes and stake fasteners; and optional touch up of flow path coatings.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A stator assembly for a gas turbine engine comprising a first end and an outer endwall coupled to a second end opposite the first end;

a first radially outer tie bar coupled to each outer endwall of a portion of the stator vanes;

at least one inner alignment pin circumferentially extending between adjacent inner end-walls to couple adjacent inner endwalls together;

at least one forward inner seal ring attached to the inner endwall; and at least one deformable seal coupled to at least one radially inner surface of the forward inner seal ring, wherein the at least one deformable seal includes an upstream facing contact surface and a radially inward facing contact surface, wherein the upstream facing contact surface adapted to accommodate contact with an up-stream rotor disk by forces resulting from gas loading of the stator vanes and pressure applied on the forward inner seal ring, wherein the at least one deformable seal comprises a honeycomb shaped seal, wherein the at least one deformable seal is formed on both the upstream facing contact surface and the radially inward facing contact surface of the forward inner seal ring, and wherein the forward inner seal ring is attached to the inner endwall by a bolt.

2. The stator assembly of claim 1, wherein at least one of the stator vanes is integrally formed with the inner endwall and outer endwall.

3. The stator assembly of claim 2, wherein each of the stator vanes are integrally formed with the inner endwall and outer endwall.

4. The stator assembly of claim 1, wherein the first radially outer tie bar is positioned within a recess in a radially outer surface the outer endwall.

5. The stator assembly of claim 1, comprising a second radially outer tie bar coupled to each outer endwall of remaining stator vanes not attached to the first radially outer tie bar, thereby forming a first stator vane segment and a second stator vane segment that together form the circumferentially extending stator assembly.

6. The stator assembly of claim 1, comprising at least one anti-rotation slot positioned in at least one of two interfaces between the first and second stator vane segments.

7. The stator assembly of claim 1, wherein the at least one inner alignment pin comprises at least one circumferentially extending forward inner alignment pin and at least one circumferentially extending aft inner alignment pin.

8. The stator assembly of claim 7, wherein the at least one circumferentially extending forward inner alignment pin is positioned forward of the generally elongated airfoil and the at least one circumferentially extending aft inner alignment pin is positioned aft of the generally elongated airfoil.

9. The stator assembly of claim 1, comprising at least one outer alignment pin extending between adjacent outer endwalls to couple adjacent outer endwalls together.

10. The stator assembly of claim 9, wherein the at least one outer alignment pin comprises at least one circumferentially extending forward outer alignment pin and at least one circumferentially extending aft outer alignment pin , wherein the at least one circumferentially extending forward outer alignment pin is positioned forward of the generally elongated airfoil and the at least one circumferentially extending aft outer alignment pin is positioned aft of the generally elongated airfoil.

11. The stator assembly of claim 1, comprising at least one aft inner seal ring attached to the inner endwall aft of at least one aft inner alignment pin.

12. The stator assembly of claim 11, comprising at least one aft deformable seal coupled to a radially inner surface of the at least one aft inner seal ring.

13. The stator assembly of claim 1, wherein the at least one forward inner seal ring is formed from a shape memory alloy.

* * * * *